US009187696B2

(12) United States Patent
Ward et al.

(10) Patent No.: US 9,187,696 B2
(45) Date of Patent: Nov. 17, 2015

(54) DELAYED COKING DRUM QUENCH OVERFLOW SYSTEMS AND METHODS

(71) Applicant: Bechtel Hydrocarbon Technology Solutions, Inc., Houston, TX (US)

(72) Inventors: John D. Ward, Katy, TX (US); Scott Alexander, Billings, MT (US)

(73) Assignee: Bechtel Hydrocarbon Technology Solutions, Inc., Houston, TX (US)

( * ) Notice: Subject to any disclaimer, the term of this patent is extended or adjusted under 35 U.S.C. 154(b) by 165 days.

(21) Appl. No.: 13/803,848

(22) Filed: Mar. 14, 2013

(65) Prior Publication Data

US 2014/0262724 A1 Sep. 18, 2014

(51) Int. Cl.

| | |
|---|---|
| ***C10G 9/14*** | (2006.01) |
| ***C10B 45/00*** | (2006.01) |
| *C10B 55/00* | (2006.01) |

(52) U.S. Cl.

CPC *C10B 45/00* (2013.01); *C10B 55/00* (2013.01)

(58) Field of Classification Search

CPC ..... C10B 39/00; C10B 39/04; C10B 39/06; C10B 45/00; C10B 55/00; C10G 9/005; C10G 9/14

USPC ..... 210/774; 208/106, 131, 48 R, 48 Q, 187; 201/39, 3

See application file for complete search history.

(56) References Cited

U.S. PATENT DOCUMENTS

| | | | | |
|---|---|---|---|---|
| 3,248,321 | A * | 4/1966 | Fagan, Jr. | 208/106 |
| 3,257,309 | A | 6/1966 | Fauchier et al. | |
| 3,917,564 | A * | 11/1975 | Meyers | 208/131 |
| 4,100,035 | A * | 7/1978 | Smith | 208/131 |
| 4,834,864 | A | 5/1989 | Mayer et al. | |
| 5,645,711 | A | 7/1997 | Hraban et al. | |
| 6,919,017 | B2 | 7/2005 | Annesley et al. | |
| 7,419,608 | B2 * | 9/2008 | Wang et al. | 208/131 |
| 2010/0270208 | A1 | 10/2010 | Ward et al. | |

FOREIGN PATENT DOCUMENTS

| | | |
|---|---|---|
| GB | 1223786 A | 3/1971 |

OTHER PUBLICATIONS

Blaine R Copenheaver, Notice of Transmittal of the International Search Report and The Written Opinion of the International Searching Authority, International Application No. PCT/US2014/028878, Jul. 29, 2014, 11 pages, International Searching Authority, Alexandria, Virginia.

Jill Warden, Notification of Transmittal of International Preliminary Report on Patentability, International Application No. PCT/US2014/028878, Jan. 22, 2015, 7 pages, International Preliminary Examining Authority, Alexandria, Virginia.

* cited by examiner

*Primary Examiner* — Jill Warden
*Assistant Examiner* — Joye L Woodard
(74) *Attorney, Agent, or Firm* — Crain, Caton & James

(57) ABSTRACT

Delayed coking drum quench overflow systems and methods, which relate to removing hydrocarbon particulates from an overflow stream in a delayed coking drum quench operation. In one embodiment, an improved overflow system incorporates one or more filters to remove hydrocarbon particulates from the system before passing through a conventional closed blowdown system.

17 Claims, 2 Drawing Sheets

DELAYED COKING DRUM QUENCH OVERFLOW SYSTEMS AND METHODS

CROSS-REFERENCE TO RELATED APPLICATIONS

Not applicable.

STATEMENT REGARDING FEDERALLY SPONSORED RESEARCH

Not applicable.

FIELD OF THE INVENTION

The present invention generally relates to delayed coking drum quench overflow systems and methods. More particularly, the invention relates to removing hydrocarbon particulates from an overflow stream in a delayed coking drum quench operation before the overflow stream enters a closed blowdown system.

BACKGROUND OF THE INVENTION

Coking is one of the older refining processes. The purpose of a coke plant is to convert heavy residual oils (e.g. tar, asphalt, etc.) into lighter, more valuable motor fuel blending stocks. Refinery coking is controlled, severe, thermal cracking. It is a process in which the high molecular weight hydrocarbon residue (normally from the bottoms of the vacuum flasher in a refinery crude unit) are cracked or broken up into smaller and more valuable hydrocarbons.

Coking is accomplished by subjecting the feed charge to an extreme temperature of approximately 930° F. that initiates the cracking process. The light hydrocarbons formed as a result of the cracking process flash off and are separated in conventional fractionating equipment. The material that is left behind after cracking is coke, which is almost pure carbon. In addition to coke, which is of value in the metal industry in the manufacture of electrodes, fuel coke, titanium dioxide, etc., the products of a coke plant include gas (refinery fuel and LPG), unstabilized (wild) gasoline, light gas oil, and heavy gas oil.

The lion's share of the world's coking capacity is represented by delayed coking processes. Delayed coking can be thought of as a continuous batch reaction. The process makes use of paired coke drums. One drum (the active drum) is used as a reaction vessel for the thermal cracking of residual oils. This active drum slowly fills with coke as the cracking process proceeds. While the active drum is being filled with coke, a second drum (the inactive drum) is in the process of having coke removed from it. The coke drums are sized so that by the time the active drum is filled with coke, the inactive drum is empty. The process flow is then switched to the empty drum, which becomes the active drum. The full drum becomes the inactive drum and is emptied or decoked. By switching the process flow back and forth between the two drums in this way, the coking operation can continue uninterrupted.

After being heated in a direct-fired furnace, the oil is charged to the bottom of the active coke drum. The cracked light hydrocarbons rise to the top of the drum where they are removed and charged to a fractionator for separation. The heavier hydrocarbons are left behind, and the retained heat causes them to crack to coke.

A closed blowdown system is often used in delayed coker quench operations to support offline coke drum operations such as, for example, water-quenching operations and backwarming operations. In FIG. 1, a schematic diagram illustrates one example of a delayed coking quench system and a closed blowdown system.

The delayed coking quench system includes a pair of coke drums 102 and 104, a coke furnace 106 and a fractionator 108. Quench water 101*a* is introduced into coke drum 102, which is offline and ready for quenching. Although coke drum 102 is offline and coke drum 104 is online, each coke drum alternates between an online and an offline status depending on the status of the other coke drum. Therefore, if coke drum 104 is offline, then the quench water 101*a* would be introduced into coke drum 104. Effluent 106*a* from a furnace 106 is sent toward the coke drums 102 and 104. A switch valve 101*b* is used to direct the effluent 106*a* to the online coke drum, which is coke drum 104 in this example. A preheated hydrocarbon feed (not shown) enters the bottom of the fractionator 108, which provides surge time for the hydrocarbon feed before it is sent to the coke furnace 106. The coke furnace 106 typically heats the hydrocarbon feed up to about 930° F., which initiates the coking reactions in the coke furnace 106. This process forms the effluent 106*a* in the coke furnace 106, which is now a three-phase stream containing oil, undergoing reaction, vapor and some coke fines also referred to as hydrocarbon particulates. As the effluent 106*a* from the coke furnace 106 enters the online coke drum 104, solid coke begins to build in the coke drum 104 as effluent 106*a* flows through the channels in the coke bed building up in the coke drum 104. When the coke level in the coke drum 104 reaches a predetermined height in the coke drum 104, then the switch valve 101*b* is used to cut off effluent 106*a* from further entering the coke drum 104 and direct the effluent 106*a* to the recently emptied coke drum 102 that is offline. In this manner, coke drum 104 then becomes the offline coke drum and coke drum 102 becomes the online coke drum.

Hot vapors leaving the online coke drum 104 are quenched immediately upon leaving the coke drum 104 to kill the coking reactions, by a controlled injection of oil from the process. This forms the overhead hydrocarbon/steam stream 103 that is sent back to the fractionator 108 through isolation valve 105*d* in a switchdeck comprising isolation values 105*a*-105*d*. The fractionator 108 separates the quenched coke drum overhead stream 104*a* into heavy gas oil, light gas oil and overhead products using fractionation techniques well known in the art. The offline coke drum 102 is steam stripped and the overhead hydrocarbon/steam stream 103 is sent to the fractionator 108 for about forty-five minutes before isolation valve 105*c* is closed and isolation valve 105*a* is opened to redirect the overhead hydrocarbon/steam stream 103 to the quench tower 110 for about another forty-five minutes. At this point, the coke drum 102 can begin the quenching process as an offline coke drum.

As the quench water 101*a* is introduced into the offline coke drum 102, the quench water 101*a* is vaporized to produce the overhead hydrocarbon/steam stream 103, containing less hydrocarbon. The overhead hydrocarbon/steam stream 103 passes through isolation valve 105*a* in the switchdeck to enter the quench tower 110. The quench water 101*a* is initially forced into the offline coke drum 102 at a lower rate that is slowly increased as the coke bed therein is cooled. The quench water 101*a* eventually will fill the offline coke drum 102 to about five feet above the coke bed level, which may still produce some steam in the overhead hydrocarbon/steam stream 103.

In the quench tower 110, the overhead hydrocarbon/steam stream 103 is reduced to a temperature of about 370° F. to minimize temperature variations in the quench tower 110. A quench tower overhead steam stream 107 substantially comprising steam exits the quench tower 110 and enters a blowdown condenser 112.

The blowdown condenser 112 simply condenses the quench tower overhead stream 107 to form a blowdown condenser outlet stream 109 that enters a blowdown settling drum 114.

In the settling drum 114, the blowdown condenser outlet stream 109 is separated into a sour water stream 111, a light slop oil stream 113 and a hydrocarbon vapor stream 115. The hydrocarbon vapor stream 115 is sent back to the fractionator 108. The light slop oil stream 113 is also returned to the fractionator 108. The sour water stream 111 is sent to a sour water stripper, which removes sulfides from the sour water stream 111.

The quench tower 110, blowdown condenser 112 and settling drum 114 are collectively referred to as the closed blowdown system. The pressure in the offline coke drum 102 is generally the same as the pressure in the closed blowdown system. At this point, the offline coke drum 102 is isolated from the closed blowdown system and is vented to the atmosphere. An ejector or small compressor may be used in a line containing the hydrocarbon vapor stream 115 to reduce the pressure in the closed blowdown system and offline coke drum 102 to about 2 psig or less prior to venting the offline coke drum 102 as required by current environmental regulation guidelines. Despite venting the offline coke drum 102 to the atmosphere at 2 psig, a plume of steam is produced that may contain hydrocarbons, possibly hydrogen sulfide, and coke fines. Maintaining a pressure of 2 psig in the offline coke drum 102 prior to venting to the atmosphere is also an issue because the coke drum pressure can spike due to continuing heat evolution from the coke bed after isolation from the closed blowdown system. On some older units, which start to vent at around 15 psig, noise is also a significant issue.

Alternatively, the delayed coking quench system illustrated in FIG. 1 may be modified to include a coke drum quench overflow stream. Although existing overflow systems are somewhat varied and similar equipment is not necessarily used, they all benefit from the procedure of overflowing a coke drum at the end of the quench operation. For example, existing overflow systems do not require an ejector or compressor at the end of the closed blowdown system to reduce pressure in the system. This ejector is used to pull the pressure in the blowdown system and coke drum down at the end of the quench operation to around 2 psig before the coke drum is isolated from the blowdown system and vented to atmosphere. The overflow stream reduces the exposure of the offline coke drum to the atmosphere and eliminates significant vapor venting. Nevertheless, problems with existing overflow schemes can include odors and gas releases or fires, plugging exchangers and residual coke fines in piping that are flushed into other equipment when the coke drums are returned to the fill cycle because the overflow stream is not filtered before entering the closed blowdown system.

Because many existing overflow systems have American Petroleum Institute ("API") separators or other equipment open to the atmosphere, there can be an emission of hydrocarbons and hydrogen sulfide, which is a serious problem. When the overflow stream is sent through an air cooler without being properly filtered, the air cooler can plug, which is also a problem in some existing overflow systems. In parts of the piping system used by existing overflow systems, coke fines are often left after the overflow operation, which are then flushed into the quench tower or fractionator when returning to the normal valving arrangement. Heavy oil or tar balls can occur in the coke bed, and if these are carried out of the coke drum by the quench water, the downstream equipment will not function well, and will require cleaning.

SUMMARY OF THE INVENTION

The present invention therefore, meets the above needs and overcomes one or more deficiencies in the prior art by providing systems and methods for removing hydrocarbon particulates from an overflow stream in a delayed coking drum quench operation before the overflow stream enters a closed blowdown system.

In one embodiment, the present invention includes a delayed coking quench overflow system, which comprises: i) a coke drum; ii) a closed blowdown system, which comprises at least one of a blowdown condenser and a settling drum; and iii) a filter system connected to the coke drum at one end by a fluid passageway and connected to the closed blowdown system at another end by another fluid passageway. wherein the filter system removes hydrocarbon particulates from an overflow stream from the coke drum that are as small as about 10-25 microns in size.

In another embodiment, the present invention includes a method for removing hydrocarbon particulates from an overflow stream in a delayed coking quench overflow system, which comprises: i) pumping an overflow stream comprising a fluid and hydrocarbon particulates from a coke drum through a filter system; ii) removing a portion of the hydrocarbon particulates from the overflow stream as the overflow stream is pumped though the filter system, wherein the filter system removes hydrocarbon particulates from the overflow stream that are as small as about 10-25 microns in size; and iii) pumping the overflow stream from the filter system through a closed blowdown system, which comprises at least one of a blowdown condenser and a settling drum.

Additional aspects, advantages and embodiments of the invention will become apparent to those skilled in the art from the following description of the various embodiments and related drawings.

BRIEF DESCRIPTION OF THE DRAWINGS

The present invention is described below with references to the accompanying drawings, in which like elements are referenced with like numerals, wherein.

DETAILED DESCRIPTION OF THE PREFERRED EMBODIMENTS

The subject matter of the present invention is described with specificity, however, the description itself is not intended to limit the scope of the invention. The subject matter thus, might also be embodied in other ways, to include different steps or combinations of steps similar to the ones described herein, in conjunction with other present or future technologies. Moreover, although the term "step" may be used herein to describe different elements of methods employed, the term should not be interpreted as implying any particular order among or between various steps herein disclosed unless otherwise expressly limited by the description to a particular order. While the following description refers to delayed coking drum quench operations, the systems and methods of the present invention are not limited thereto and may be applied in other operations to achieve similar results.

Figure 2:
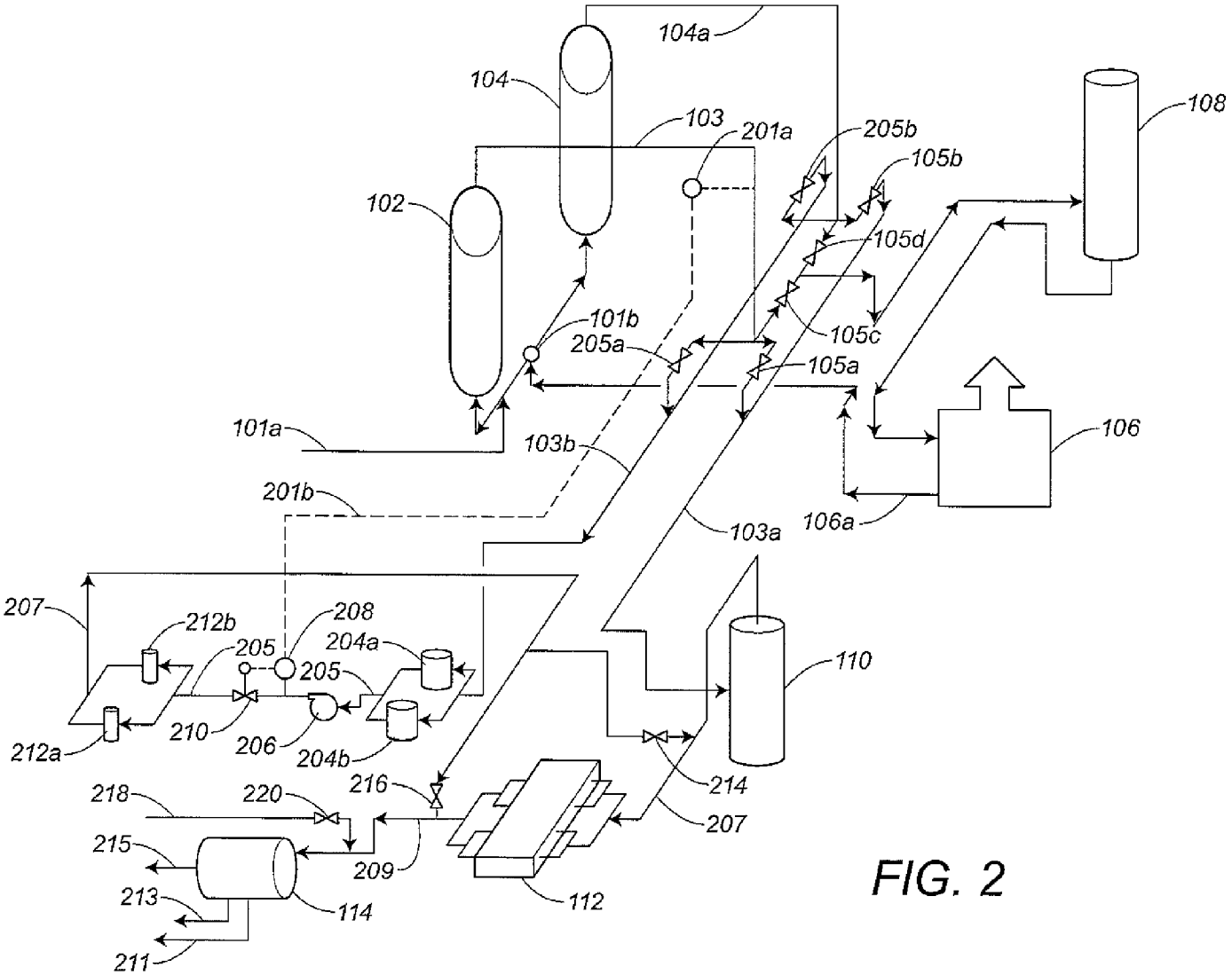
FIG. 2 is a schematic diagram illustrating a delayed coking quench overflow system and a closed blowdown system according to the present invention.

Referring now to FIG. 2, a schematic diagram illustrates an improved delayed coking quench overflow system and a closed blowdown system according to the present invention.

In this improved overflow system, the quench water 101*a* continues to flow into the offline coke drum 102 above the level of the coke to overflow the top of the offline coke drum 102, which forms the overhead hydrocarbon/steam stream 103. At this point, the offline coke drum 102 is deemed to be in an overflow quench mode. The overhead hydrocarbon/steam stream 103 flows into a switchdeck, which now includes isolation valves 105*a*-105*d*, 205*a* and 205*b*. Isolation valve 105*a* is therefore closed and isolation valve 205*a* is opened so that the overhead hydrocarbon/steam stream 103*b* may be directed to a new filter system comprising a pair of debris filters 204*a* and 204*b*. Because there are two debris filters, they may be connected in series (not shown) or in parallel (shown). If they are connected in parallel, then one may be online while the other is offline. The debris filters 204*a* and 204*b* are intended to remove heavy hydrocarbon particulates, which may be anything larger than about ⅜ inch in size.

A filtered water stream 205 exits the debris filters 204*a* or 204*b*, which enters an overflow pump system 206 used to pump the filtered water stream 205 through a control valve 210 into a pair of coke fines filters 212*a* and 212*b*. The overflow pump system 206 may include coke crushing impellers to handle any hydrocarbon particulates smaller than ⅜ inch. The control valve 210 is controlled by a flow controller 208. A level transmitter 201*a* is connected to the flow controller 208 by circuitry 201*b* and reads a water level for the overhead hydrocarbon/steam stream 103*b* to maintain sufficient static head pressure and allow the debris filters 204*a* and 204*b* to function properly. In order to control the level of the overhead hydrocarbon/steam stream 103*b*, either the capacity of the overflow pump system 206 must equal the capacity of the pumps for the quench water 101*a*, or the quench water pump capacity can be controlled to limit flow into the overflow system. For a 40,000 bpsd unit that uses two quench water pumps with a combined capacity of 1200-1600 gpm, the overflow pump system 206 would have to have a capacity equal to this. The debris filters 204*a* and 204*b* may be backwashed automatically with filtered water. If a pressure drop in the debris filters 204*a* and 204*b* is too high after backwashing, then the flow can be automatically switched to a spare offline debris filter. If the system pressure remains too high, then the pumps for the quench water 101*a* may be tripped. Preferably, the pressure at an outlet for the debris filters 204*a* and 204*b* will be at least about 45 psig.

The coke furies filters 212a and 212b may be connected in series (not shown) or in parallel (shown) to remove hydrocarbon particulates from the filtered water stream 205, which were not removed by the debris filters 204*a* or 204*b* and may be as small as about 10-15 microns in size. Smaller hydrocarbon particulates may be removed, however, with the selection of different filters. Additional coke fines filters may be used wherein one or more may be designated online and one or more may be designated offline.

Figure 1:
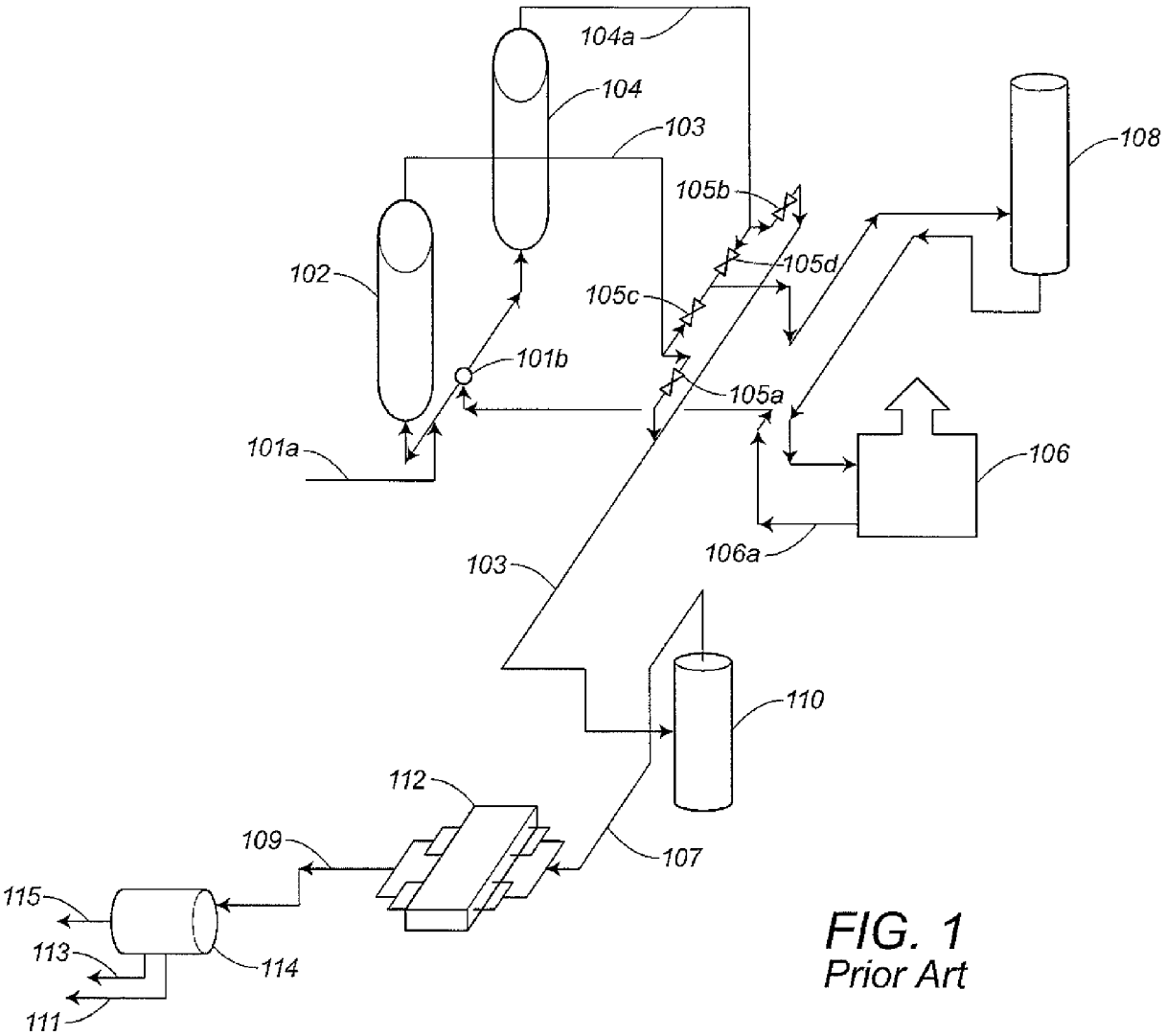
FIG. 1 Prior Art
FIG. 1 is a schematic diagram illustrating a closed blowdown system.

A fines filtered water stream 207 exits the coke fines filters 212*a* and 212*b* and is directed through an open control valve 214 into a modified closed blowdown system comprising a quench tower 110, a blowdown condenser 112 and a settling drum 114. The fines filtered water stream 207 therefore, bypasses the quench tower 110 and enters the blowdown condenser 112 wherein it is condensed into a blowdown condenser outlet stream 209. The blowdown condenser outlet stream 209, like the blowdown condenser outlet stream 109 in FIG. 1, includes some hydrocarbons and water, however, at a lower temperature of about 140° F.

The blowdown condenser outlet stream 209 passes into the settling drum 114 where it is separated into a sour water stream 211, a light slop oil stream 213 and a hydrocarbon vapor stream 215. The hydrocarbon vapor stream 215 is sent back to the fractionator 108. The light slop oil stream 213 is also returned to the fractionator 108. The sour water stream 211 is sent to a water stripper, which removes sulfides from the sour water stream 211.

In the event that hydrocarbon particulates are still entering the blowdown condenser 112 from the fines filtered water stream 207, the fines filtered water stream 207 may be redirected around the blowdown condenser 112 through open check valve 216 wherein the fines filtered water stream 207 is mixed with a cold water injection stream 218 that passes through an open check valve 220. The cold water injection stream 218 therefore, reduces the temperature of the fines filtered water stream 207 for better separation of the sour water stream 211, light slop oil stream 213 and hydrocarbon vapor stream 215 in the settling drum 114.

Once the overflow operation is complete and the temperature and pressure in the offline coke drum 102 are significantly lowered to essentially atmospheric pressure and the water temperature is less than 212° F., the offline coke drum 102 may be opened to remove the coke therein. At this point, the pressure in the offline coke drum 102 should be atmospheric pressure or 0 psig.

The improved overflow system thus, avoids the emissions problems associated with conventional delayed coking drum quench systems and overcomes the problems with conventional overflow systems by incorporating a filtration system that significantly removes the hydrocarbon particulates from the overflow stream before they enter the closed blowdown system. In addition, the improved overflow system illustrated in FIG. 2 adapts well to work with the same components used in the conventional delayed coking drum quench system and the closed blowdown system illustrated in FIG. 1. As a result, nominal retrofitting is necessary to incorporate the filtration system into a conventional delayed coking drum quench system and closed blowdown system. It is worth noting that if the improved overflow system is designed as illustrated in FIG. 2 with a conventional closed blowdown system, then the operator always has the option to stop the overflow operation, drain off the overhead hydrocarbon/steam stream 103*b* and revert to the conventional delayed coking drum quench system illustrated in FIG. 1.

While the present invention has been described in connection with presently preferred embodiments, it will be understood by those skilled in the art that it is not intended to limit the invention to those embodiments. For example, it is anticipated that by routing certain streams differently or by adjusting operating parameters, different optimizations and efficiencies may be obtained, which would nevertheless not cause the system to fall outside of the scope of the present invention. It is therefore, contemplated that various alternative embodiments and modifications may be made to the disclosed embodiments without departing from the spirit and scope of the invention defined by the appended claims and equivalents thereof.

The invention claimed is:

1. A method for removing hydrocarbon particulates from an overflow stream in a delayed coking quench overflow system, which comprises:

pumping an overflow stream comprising a fluid and hydrocarbon particulates from a coke drum through a filter system;

removing a portion of the hydrocarbon particulates from the overflow stream as the overflow stream is pumped though the filter system, wherein the filter system removes hydrocarbon particulates from the overflow stream that are as small as about 10-25 microns in size; and pumping the overflow stream from the filter system through a closed blowdown system, which comprises at least one of a blowdown condenser and a settling drum.

2. The method of claim 1, wherein the filter system comprises a debris filter for removing hydrocarbon particulates from the overflow stream that are larger than about ⅜ inch in size.

3. The method of claim 2, wherein the filter system comprises another debris filter for removing hydrocarbon particulates from the overflow stream that are larger than about ⅜ inch in size.

4. The method of claim 1, wherein the filter system comprises a coke fines filter for removing the hydrocarbon particulates from the overflow stream that are as small as about 10-25 microns in size.

5. The method of claim 4, wherein the filter system comprises another coke fines filter for removing the hydrocarbon particulates from the overflow stream that are as small as about 10-25 microns in size.

6. The method of claim 1, further comprising controlling a flow of the overflow stream through the filter system with an overflow pump and a flow controller.

7. The method of claim 6, further comprising maintaining a predetermined static head pressure in the filter system using the flow controller, the overflow pump and a pump for pumping a fluid into the coke drum.

8. The method of claim 1, further comprising:

pumping the overflow stream around the blowdown condenser through the settling drum; and mixing the overflow stream with a cooled fluid to reduce a temperature of the overflow stream before entering the settling drum.

9. A delayed coking quench overflow system, which comprises:

a coke drum;

a closed blowdown system, which comprises at least one of a blowdown condenser and a settling drum; and a filter system connected to the coke drum at one end by a fluid passageway and connected to the closed blowdown system at another end by another fluid passageway, wherein the filter system removes hydrocarbon particulates from an overflow stream from the coke drum that are as small as about 10-25 microns in size.

10. The system of claim 9, wherein the filter system comprises a debris filter for removing hydrocarbon particulates from the overflow stream that are larger than about ⅜ inch in size.

11. The system of claim 10, wherein the filter system comprises another debris filter for removing hydrocarbon particulates from the overflow stream that are larger than about ⅜ inch in size.

12. The system of claim 11, wherein the debris filter and the another debris filter are connected in series or in parallel.

13. The system of claim 9, wherein the filter system comprises a coke fines filter for removing the hydrocarbon particulates from the overflow stream that are as small as about 10-25 microns in size.

14. The system of claim 13, wherein the filter system comprises another coke fines filter for removing the hydrocarbon particulates from the overflow stream that are as small as about 10-25 microns in size.

15. The system of claim 14, wherein the coke fines filter and another coke fines filter are connected in series or in parallel.

16. The system of claim 9, wherein the filter system comprises an overflow pump and a flow controller for controlling a flow of the overflow stream through the filter system.

17. The system of claim 16, wherein a capacity for the overflow pump is about equal to a capacity for a pump used to pump a fluid into the coke drum.

* * * * *